US006394118B1

(12) United States Patent
Cikanowick et al.

(10) Patent No.: US 6,394,118 B1
(45) **Date of Patent: *May 28, 2002**

(54) QUICK SETUP CANOPY APPARATUS

(76) Inventors: Donald S. Cikanowick, 14 Red Fox Trail, Greenville, SC (US) 29615; Gary Munson, 1 Gillin Dr., Simpsonville, SC (US) 29680

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/056,488

(22) Filed: Apr. 7, 1998

(51) Int. Cl.[7] ..... E04H 15/06

(52) U.S. Cl. ..... 135/88.06; 135/88.13; 135/90; 135/132; 135/115

(58) Field of Search ..... 135/88.01, 88.02, 135/88.06, 88.13, 88.16, 90, 94, 132, 136, 139, 148, 153, 155, 114, 906; 248/511

(56) References Cited

U.S. PATENT DOCUMENTS

| | | | | | |
|---|---|---|---|---|---|
| 1,830,018 | A | * | 11/1931 | Darnell | 135/90 |
| 2,480,509 | A | | 8/1949 | Ripley | |
| 2,615,458 | A | * | 10/1952 | Jones | 135/132 |
| 2,631,057 | A | * | 3/1953 | Weaklend | 135/137 X |
| 2,798,501 | A | * | 7/1957 | Oliver | 135/906 X |
| 3,036,583 | A | * | 5/1962 | Miller | 135/132 |
| 3,463,174 | A | * | 8/1969 | Heller | 135/88.06 |
| 3,870,061 | A | | 3/1975 | Lowery | |
| 3,940,099 | A | | 2/1976 | McCleskey | |
| 4,605,030 | A | * | 8/1986 | Johnson | 135/148 X |
| 4,834,128 | A | | 5/1989 | Burgess | |
| 4,944,321 | A | * | 7/1990 | Moyet-Ortiz | 135/148 X |
| 5,135,281 | A | * | 8/1992 | Pappalardo | 135/90 X |
| 5,158,103 | A | | 10/1992 | Leu | |
| 5,168,889 | A | * | 12/1992 | Diestel | 135/88.01 |
| 5,601,104 | A | * | 2/1997 | Perkins | 135/88.06 |

* cited by examiner

*Primary Examiner*—Carl D. Friedman
*Assistant Examiner*—Winnie Yip
(74) *Attorney, Agent, or Firm*—Nelson Mullins Riley & Scarborough

(57) ABSTRACT

A quick setup canopy apparatus is configured for use at the end of a vehicle. The apparatus includes a pair of base plate units adapted to be anchored by the weight of respective vehicle wheels. Each of the base plate units has a respective support member pivotally connected thereto. An arcuate web support frame is connected to distal ends of the support members in cantilevered fashion. A flexible web material is maintained on the web support frame to provide a covered canopy region underneath. Preferably, the framework of the apparatus comprises a plurality of telescopically connected rod elements to permit storage in a relatively small volume.

18 Claims, 8 Drawing Sheets

FIG. 8.
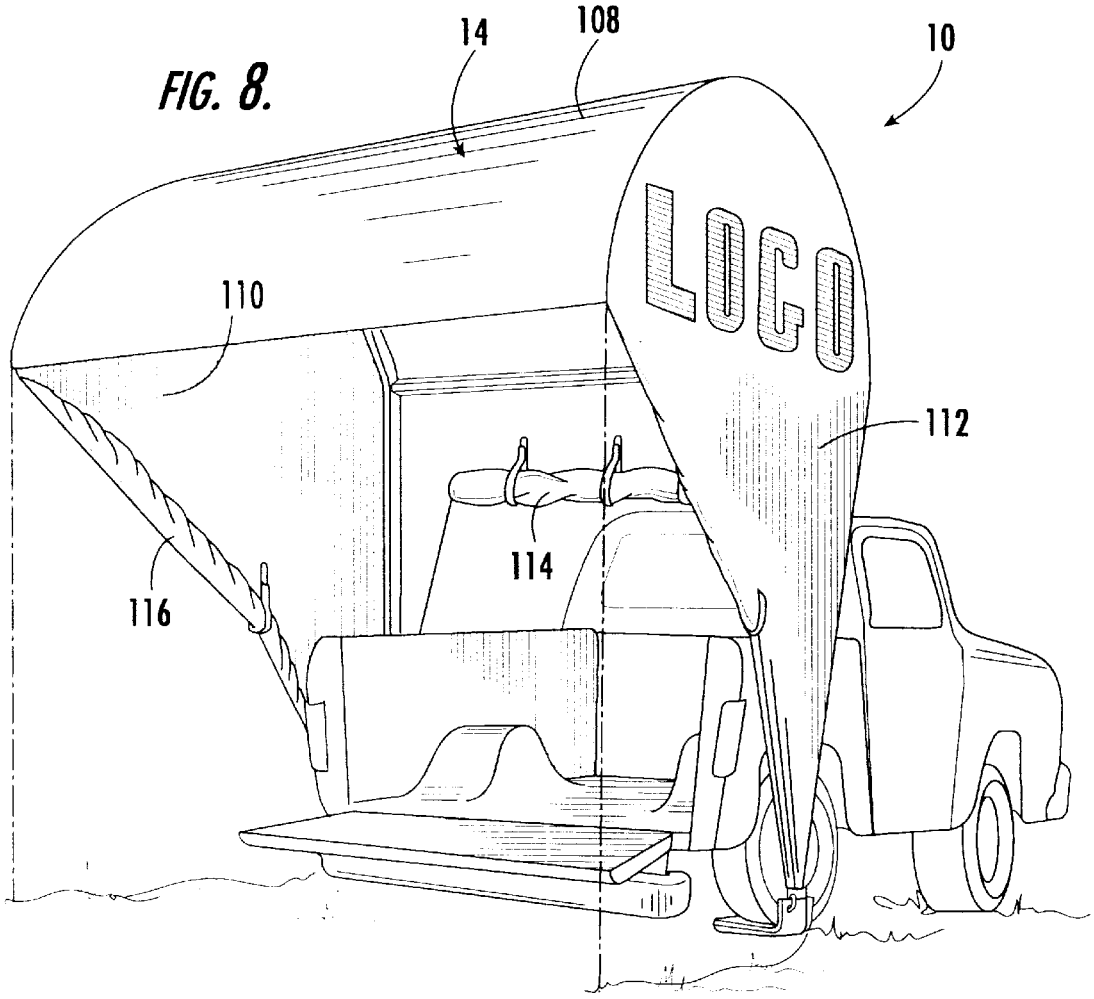
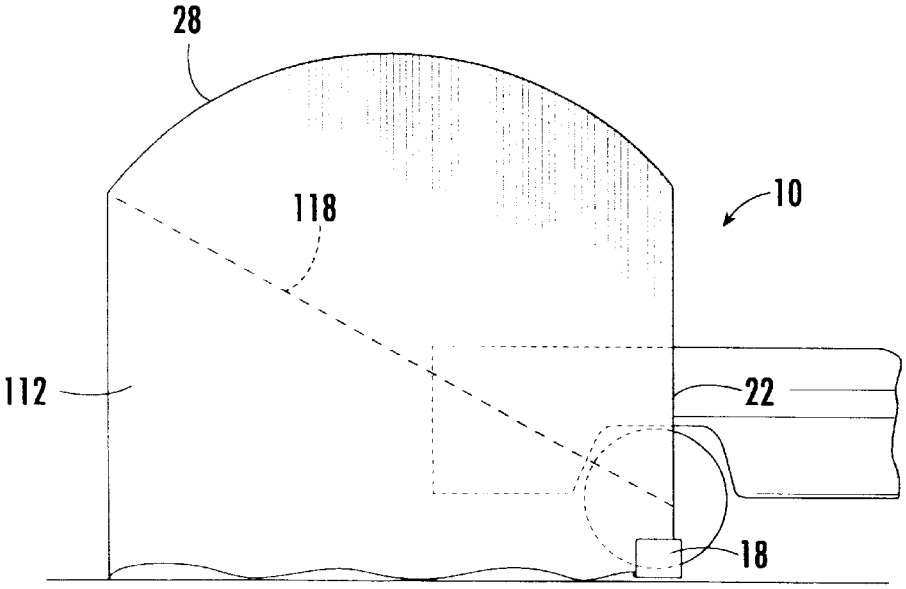
FIG. 8A.

QUICK SETUP CANOPY APPARATUS

BACKGROUND OF THE INVENTION

The present invention relates generally to a quick setup canopy apparatus for use in a variety of applications. More particularly, the present invention relates to an improved vehicle anchored canopy apparatus adapted for quick setup.

Temporary canopies are utilized during many outdoor activities to provide protection from sun or wind. Often, these activities may involve use of a vehicle. For example, sports fans frequently engage in "tailgate" parties before attending a sporting event. Likewise, vendors at flea markets and the like often sell their wares directly from a vehicle.

The prior art has recognized that the weight of a vehicle can be used as an anchor to reduce or eliminate the need for mounting stakes and the like. Vehicle-anchored tents of the prior art, however, have generally extended out from the side of the vehicle. The use of such a structure is prevented where the anchoring vehicle is parked directly beside other vehicles, such as in a parking lot.

To provide maximum benefit to the user, the canopy should be configured for quick setup while permitting storage in a relatively small volume when disassembled.

SUMMARY OF THE INVENTION

The present invention recognizes the foregoing and other disadvantages of prior art constructions and methods. Accordingly, it is an object of the present invention to provide an improved temporary canopy apparatus.

It is a further object of the present invention to provide an improved vehicle anchored canopy apparatus.

It is a more particular object of the present invention to provide a vehicle anchored canopy apparatus adapted for use at an end of a vehicle.

It is also a particular object of the present invention to provide a vehicle anchored canopy apparatus which can be disassembled for storage in a relatively small volume.

Some of these objects are achieved by a canopy apparatus for use at the end of a vehicle. The canopy apparatus comprises a base structure having anchoring plate portions configured to be respectively placed under opposite lateral wheels of the vehicle such that the base structure is maintained in position. First and second support members, spaced apart from one another by a predetermined separation, have respective proximal ends connected to the base structure. A web support frame is connected to a distal portion of the respective support members and extends outwardly therefrom. The canopy apparatus further includes a flexible web material maintained by the web support frame to provide a covered canopy region underneath.

In some exemplary embodiments, the support members are pivotally connected to the base structure for movement between a lowered position and an upstanding position. Furthermore, the web support frame may define an arcuate configuration extending outwardly from respective distal ends of the support members. For example, the web support frame may comprise first and second parallel arcuate members and a plurality of cross members extending therebetween.

It may often be desirable to provide at least one strap to tension the flexible web material on the web support frame. In addition, the flexible web material may be configured to define a pair of opposed side panels. In such embodiments, the side panels may be adapted to be maintained in either of a first position partially raised along a diagonal and a second position lowered substantially to ground level.

Preferably, the support members and the web support frame each comprise a plurality of shorter rod elements connected together via removable connection mechanisms. The base structure may comprise first and second base plate units associated with respective of the vehicle tires.

Other objects of the present invention are achieved by a quick setup canopy apparatus comprising a base structure adapted to be anchored in position. First and second support members are also provided, spaced apart from one another by a predetermined separation. The support members have respective proximal ends pivotally connected to the base structure for movement between a lowered position and an upstanding position. A web support frame, defining an arcuate configuration, extends outwardly from a distal portion of the respective support members. A flexible web material is maintained by the web support frame to provide a covered canopy region underneath.

In some exemplary embodiments, the base structure is adapted to be anchored in position by wheels of a motor vehicle. For example, the base structure may comprise first and second base plate units associated with respective vehicle tires. The base structure may preferably comprise a locking mechanism operative to maintain the support members in the upstanding position.

Other objects of the present invention are achieved by a canopy apparatus for use at the end of a vehicle. The canopy apparatus comprises a base structure having anchoring plate portions configured to be placed under opposite lateral wheels of the vehicle to be maintained in position. First and second support members, spaced apart from one another by a predetermined separation, have respective proximal ends pivotally connected to the base structure for movement between a lowered position and an upstanding position. A web support frame, defining an arcuate configuration, extends outwardly from respective distal portions of the support members. A flexible web material is maintained by the web support frame to provide a covered canopy region underneath. The flexible web material defines a pair of opposed side panels adapted to be maintained in either of a first position partially raised along a diagonal and a second position lowered substantially to ground level. At least one diagonal strap is provided to tension the flexible web material on the web support frame.

Other objects, features and aspects of the present invention are provided by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which:

FIG. 8 is a front perspective view of the canopy apparatus illustrating user-selected logo on a side panel thereof;

FIG. 8A is a diagrammatic representation of the erected canopy assembly showing a canopy side panel in a fully lowered position.

Figure 1:
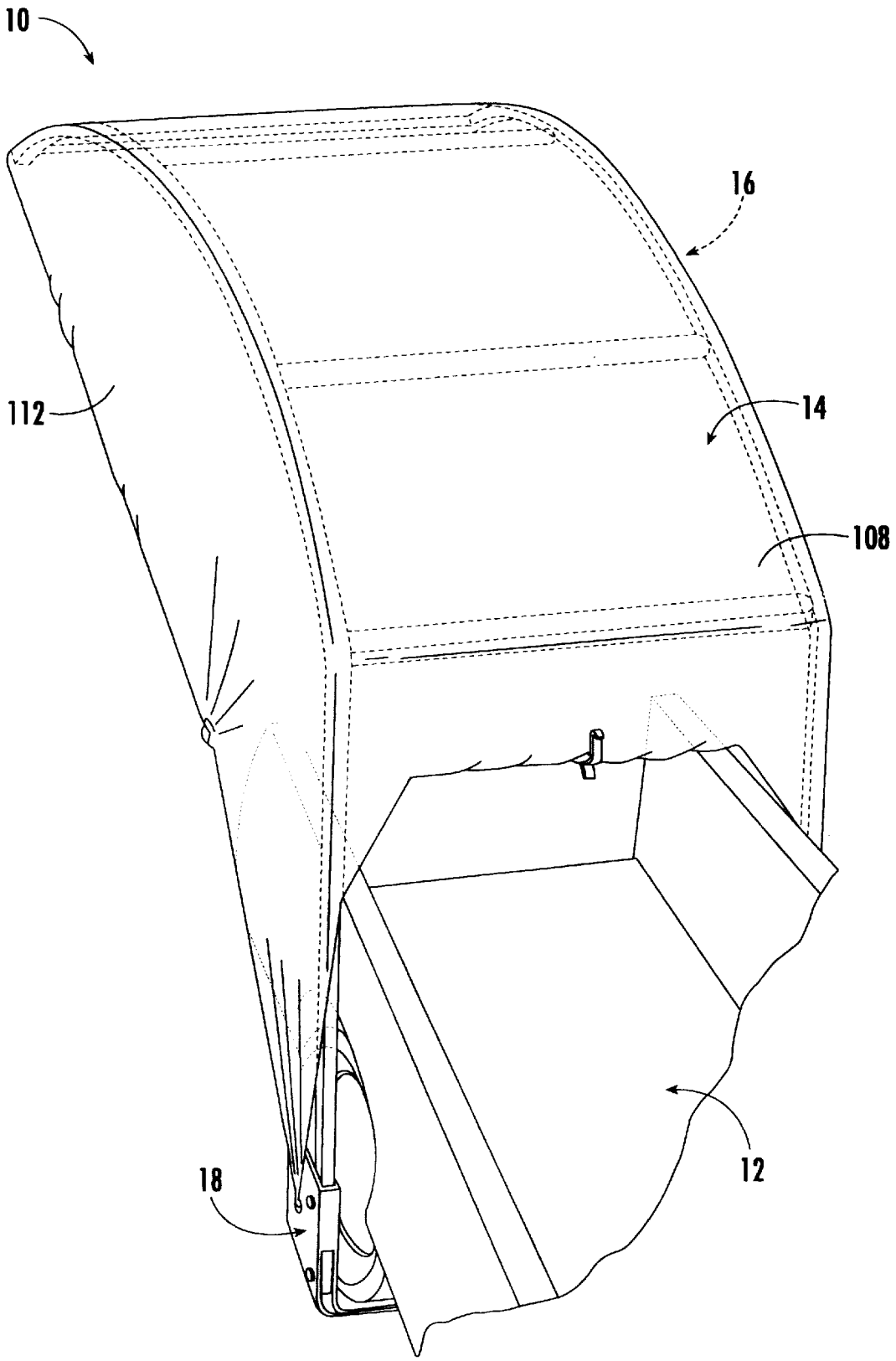
FIG. 1 is a back perspective view of a preferred embodiment of a canopy apparatus constructed in accordance with the present invention, erected at the end of a vehicle.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

The present invention provides a canopy apparatus for use at the end of a vehicle, such as a car, truck or van. In other words, the apparatus extends outwardly from the front or rear of the vehicle, instead of the sides as has been the case with many prior art devices. Thus, referring to FIG. 1, a canopy apparatus 10 of the present invention is shown erected at the bed portion 12 of a pickup truck. As can be seen, apparatus 10 includes a flexible web material 14 maintained on a rigid framework 16. Framework 16 extends away from bed portion 12 to provide a covered canopy region behind the truck. As a result, bed portion 12 of the truck may be conveniently used during the outdoor activity for which canopy apparatus 10 is employed.

Figure 2:
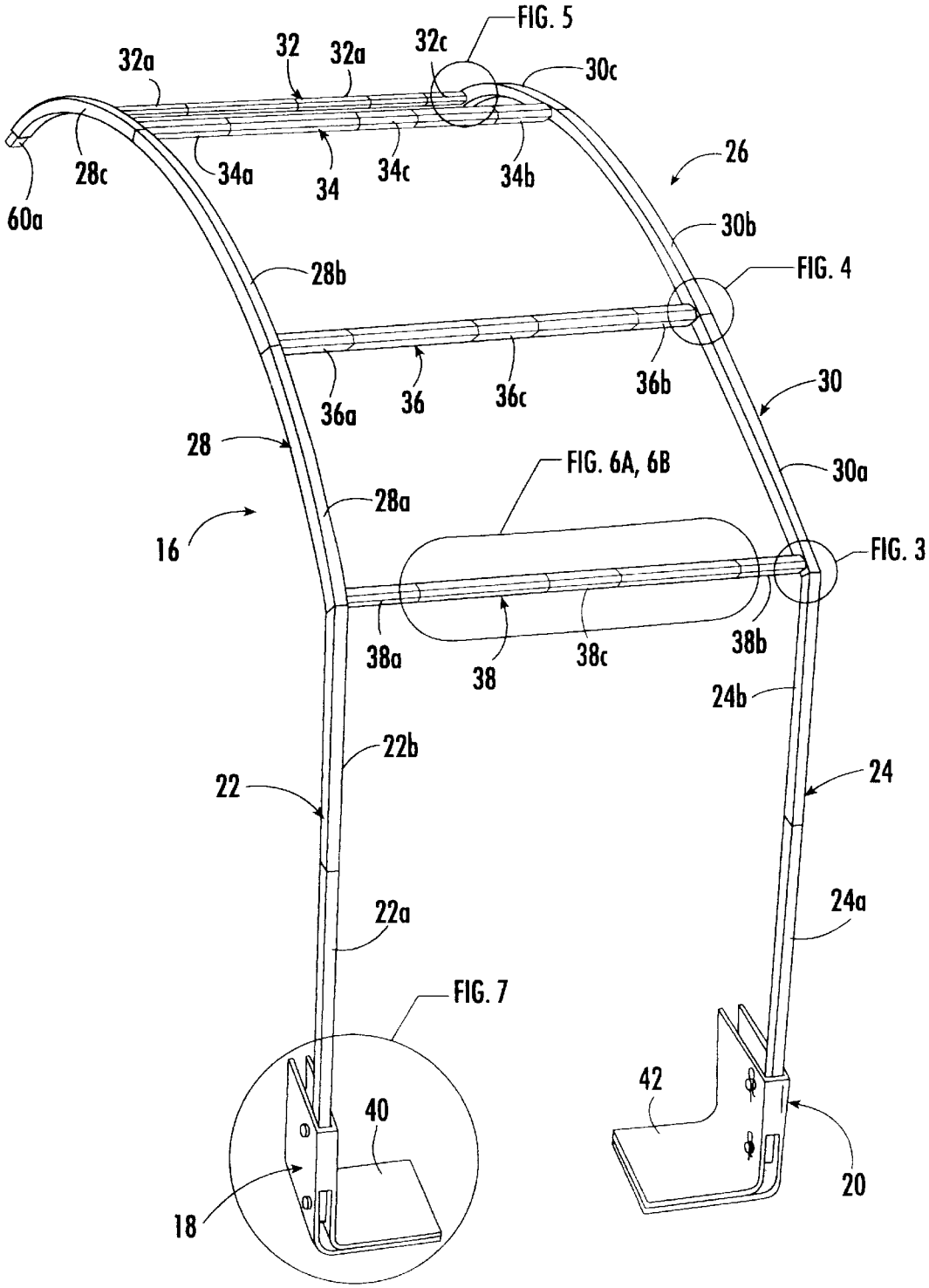
FIG. 2 is a perspective view showing the framework of the canopy apparatus of FIG. 1 with the flexible web material removed.

The construction of framework 16 can be most easily explained with continuous reference to FIG. 2 and specific reference to other Figures as indicated therein. Generally, framework 16 includes a base plate structure comprising a pair of base plate units 18 and 20. Respective support members 22 and 24 are connected to base plate units 18 and 20. In addition, an arcuate web support frame 26 extends in cantilevered fashion from the distal ends of support members 22 and 24. As shown, web support frame 26 includes a pair of parallel arcuate members 28 and 30. The desired separation between arcuate members 28 and 30 is maintained by a plurality of cross members 32, 34, 36 and 38.

Figure 2A:
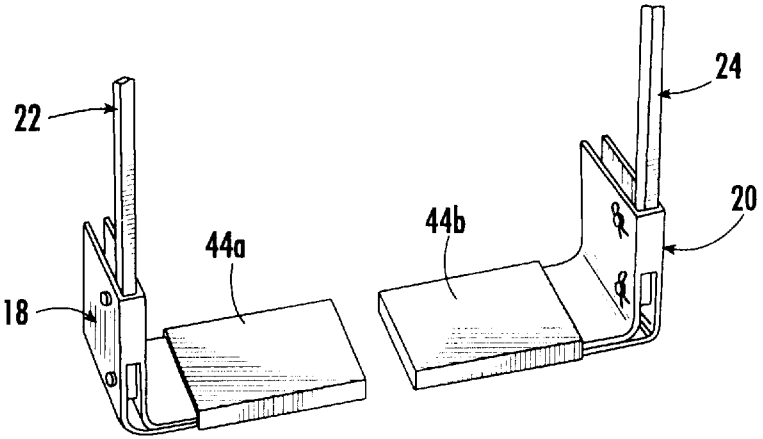
FIG. 2A is a perspective view of a modified base structure having extension plates.

Base plate units 18 and 20 include respective plate portions 40 and 42 for receipt of a vehicle wheel thereon. As a result, canopy apparatus 10 will be firmly anchored in position without the need for mounting stakes and the like. Alternatively, as shown in FIG. 2A, extension plates 44*a* and 44*b* may be slid over respective plate portions 40 and 42. The use of extension plates 44*a* and 44*b* permits canopy apparatus 10 to be used with a wide variety of vehicles having different wheel spacings. It will be appreciated that a unitary extension plate may be utilized, instead of separate extension plates for each base plate as illustrated.

Framework 16 is preferably constructed so that it may be easily disassembled and stored in a relatively small volume. For example, all of the various components of framework 16, along with flexible web material 14, may be maintained in a single duffle bag or the like. This bag may be conveniently stored in the vehicle trunk until it is desired to erect canopy apparatus 10. Toward this end, the various elongate members of framework 16 are preferably constructed of shorter rod elements that may be connected telescopically. The various pieces, which may be made from tubular aluminum or other suitable material, are preferably designated by color-coding or the like to facilitate assembly.

For example, it can be seen that support members 22 and 24 comprise respective rod elements 22*a–b* and 24*a–b*. Similarly, arcuate members 28 and 30 comprise respective rod elements 28*a–c* and 30*a–c*. In this case, each of the cross members comprises two end rods (suffix "a" and "b", respectively) having an interconnecting unit (suffix "c") situated therebetween.

Figure 3:
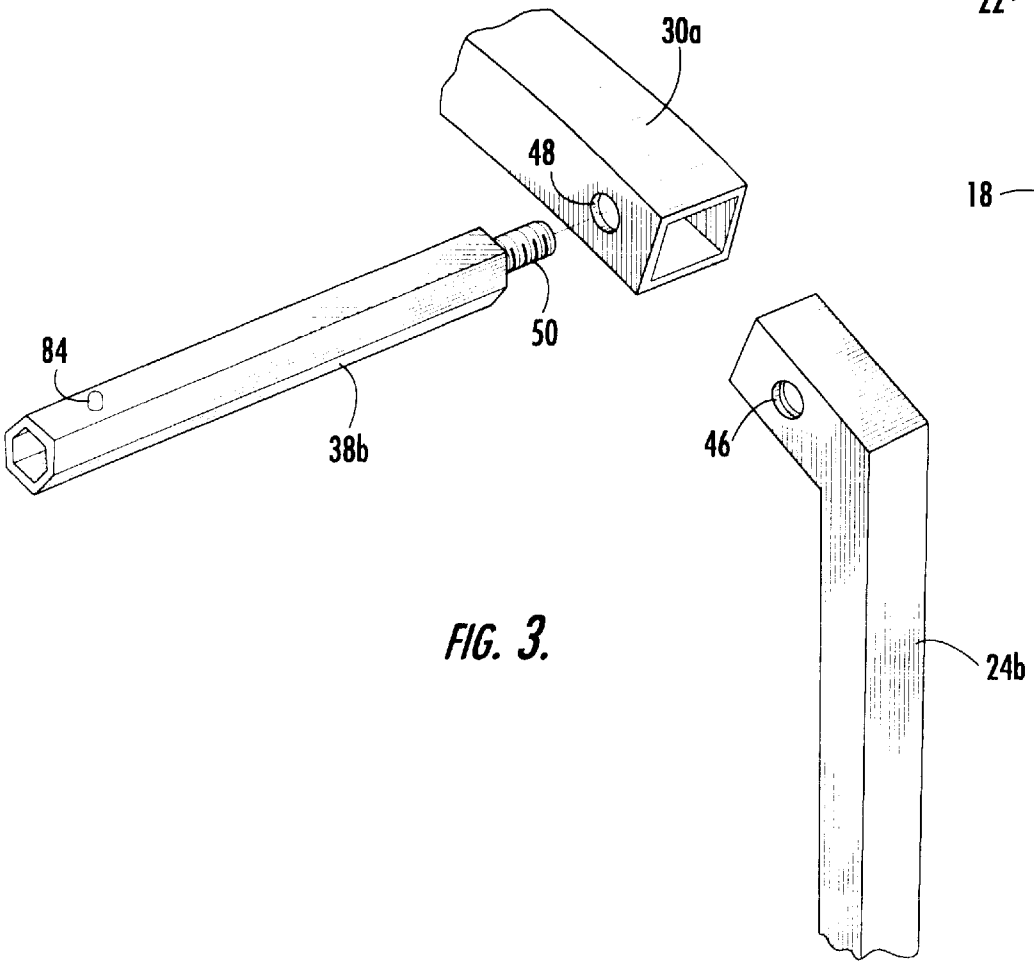
FIGS. 3 through 5 are fragmentary perspective views showing connection points of the framework for purposes of illustration.

As will now be explained with reference to FIGS. 3–5, the end rod of each cross member is preferably connected at a joint between two telescopically mating rod elements. In FIG. 3, for example, end rod 38*b* is connected at the telescopic joint of rod elements 24*b* and 30*a*. Toward this end, rod element 24*b* defines a threaded hole 46 which will register with a hole 48 defined in rod element 30*a*. The joint is secured by a threaded extension 50 of end rod 38*b*, which passes through hole 48 to engage hole 46.

Figure 4:
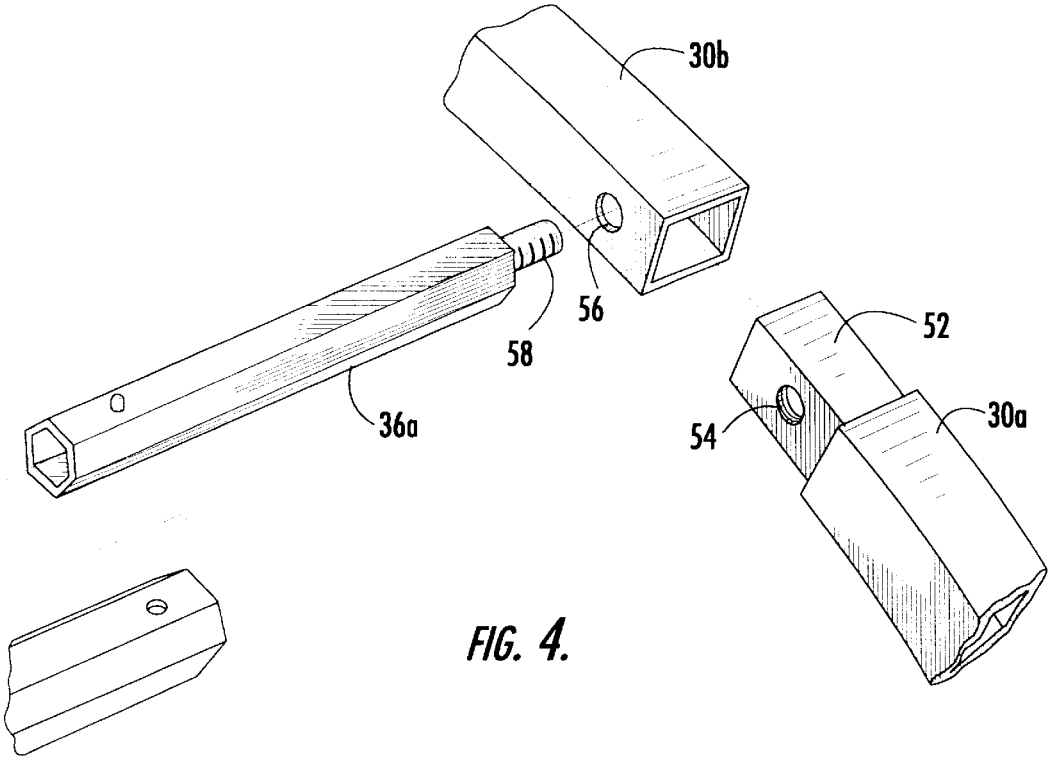

Referring now to FIG. 4, the opposite end of rod element 30*a* includes a reduced dimension portion 52 that is telescopically received into an end of rod element 30*b*. As can be seen, portion 52 defines a threaded hole 54 which registers with a hole 56 defined in rod element 30*b*. Threaded hole 54 is engaged by threaded extension 58 of end rod 36*a*.

Figure 5:
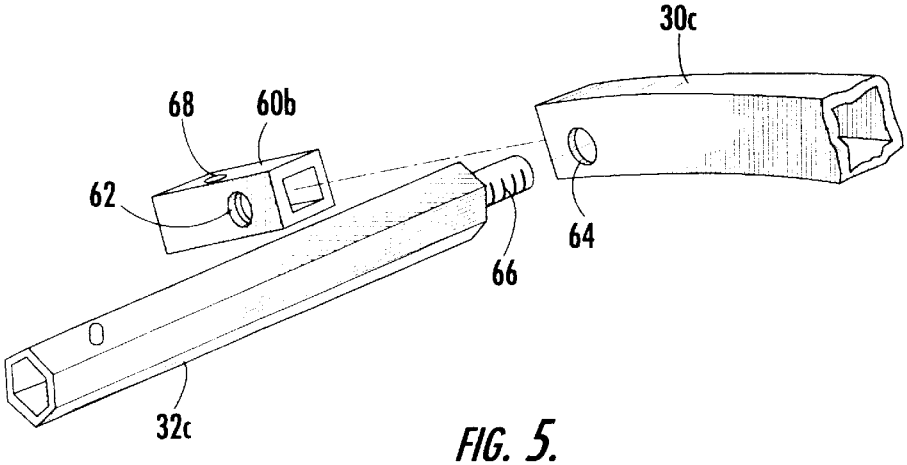

As shown in FIG. 5, a short terminal piece 60*b* is received into the outermost end of rod element 30*c*. Terminal piece 60*b* defines a threaded hole 62 which registers with a hole 64, defined in rod element 30*c*, to receive threaded extension 66. As a result, terminal piece 60*b* will be securely maintained in position. Terminal piece 60*b* will preferably include an attachment hole 68 (or alternatively a peg, hook or the like), by which one corner of flexible web material 14 can be secured to framework 16.

The manner in which the cross members are assembled can be most easily explained with reference to FIGS. 6A and 6B. As shown, interconnecting member 38*c* includes a main rod portion 70 having a pair of slidable elements 72 and 74 located thereon. Slidable elements 72 and 74 each define a pair of holes, respectively designated 76*a–b* and 78*a–b*, located in axial alignment with spring-loaded pegs 80 and 82 of main rod portion 70.

Figure 6A:
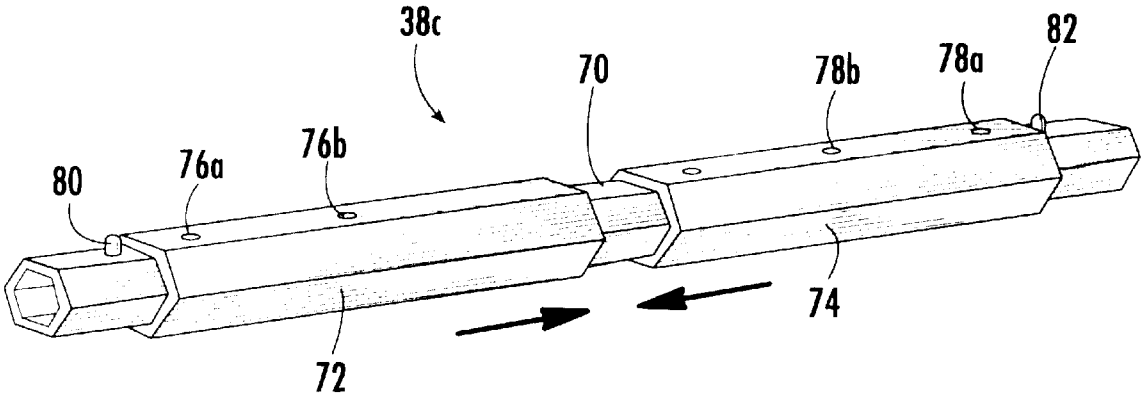
FIGS. 6A and 6B are perspective views illustrating use of quick-connect cross members as are preferably employed in the canopy apparatus.
Figure 6B:
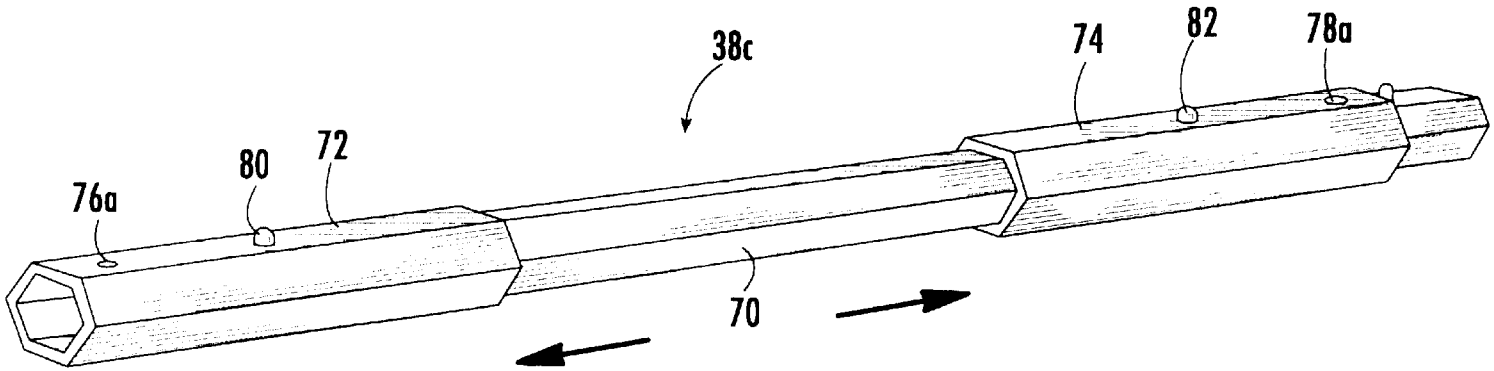

During assembly of the cross member, slidable elements 72 and 74 are first moved toward one another as illustrated in FIG. 6A. Main rod portion 70 is then axially aligned with end rods 38*a* and 38*b*, the other ends of which may have been previously secured at a joint location as described above. Next, as shown in FIG. 6B, slidable elements 72 and 74 are moved outward until pegs 80 and 82 become locked in holes 76*b* and 78*b*, respectively. A spring loaded peg on each end rod, such as peg 84 (FIG. 3) will likewise become locked in one of holes 76*a* and 78*a*.

Figure 7:
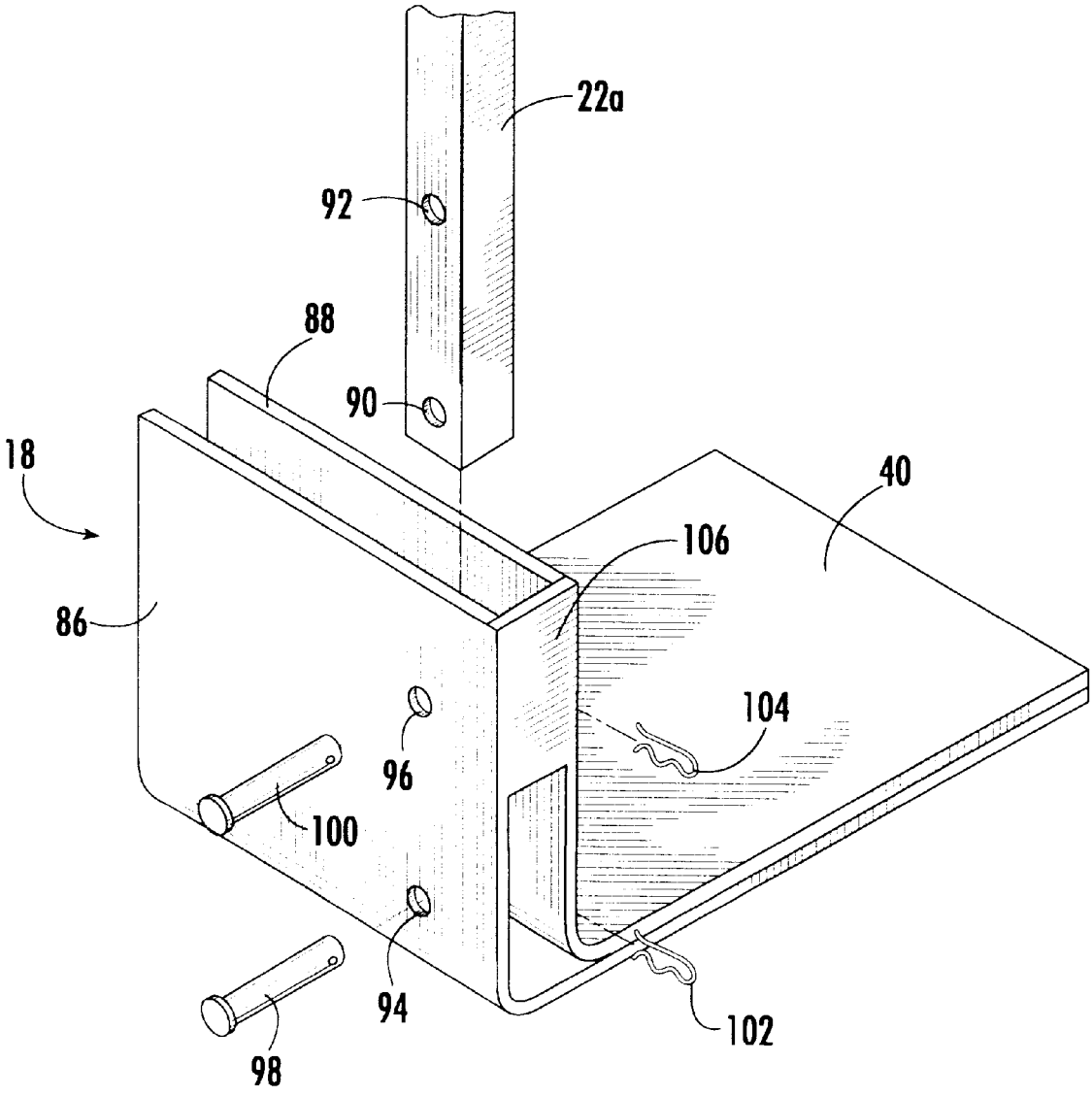
FIG. 7 is a perspective view of a base plate unit of the canopy apparatus for use under a single wheel of the vehicle.

For purposes of explanation, an enlarged view of base plate unit 18 is shown in FIG. 7. As can be seen, plate portion 40 integrally extends into a vertical portion having a pair of opposed plates 86 and 88. Plates 86 and 88 are spaced for receipt of rod element 22*a* therebetween. Rod element 22*a* defines a pair of bores 90 and 92, which register with holes defined in plates 86 and 88 (such as holes 94 and 96 of plate 86). Pins 98 and 100 extend through the aligned holes, and are suitably retained such as by respective clips 102 and 104.

It will be appreciated that rod element 22*a* (and thus other connected elements) rotates about pin 98 during setup. Pin 100 thus functions to maintain rod element 22*a* in an upstanding position. Alternatively, the base plate unit may be configured such that rod element 22*a* is maintained between pin 100 and backplate 106 after it has been pivoted to an upstanding position. In this latter case, it may be unnecessary to provide a second bore in rod element 22*a*.

Various additional features of canopy apparatus 10 can be seen in FIG. 8. As shown, flexible web material 14 comprises a main canopy panel 108, as well as a pair of side panels 110 and 112. The back portion of main canopy panel 108 is preferably cut away to provide an adjustable flap as indicated at 114. Flap 114 may be lowered or raised to accommodate vehicles of different sizes. Side panels 110 and 112 are also preferably adaptable to be folded and maintained along the diagonal, as indicated for example at 116. Straps having hook and pile fasteners, or other suitable attachment means, may be utilized to retain the folded web material in position.

Referring now also to FIG. 8A, side panels 110 and 112 may be unfolded in order to provide a more enclosed canopy area. In this case, side panels 110 and 112 may desirably extend substantially completely to ground level. Stakes or the like may be driven into the ground to secure the bottoms of side panels 110 and 112 when in this lowered position. It can also be seen that side panels 110 and 112 advantageously provide a "billboard" on which desired indicia, such as advertising or a sports team logo, may be placed.

The design of canopy apparatus 10 permits flexible web material 14 to be securely maintained on the supporting framework with relatively few points of connection. Once the web material 14 is in position, it may be tightened with tightening straps. In the illustrated embodiment, only two tightening straps are utilized, running inside of the side panels along a diagonal as indicated at 118.

Figure 9A:
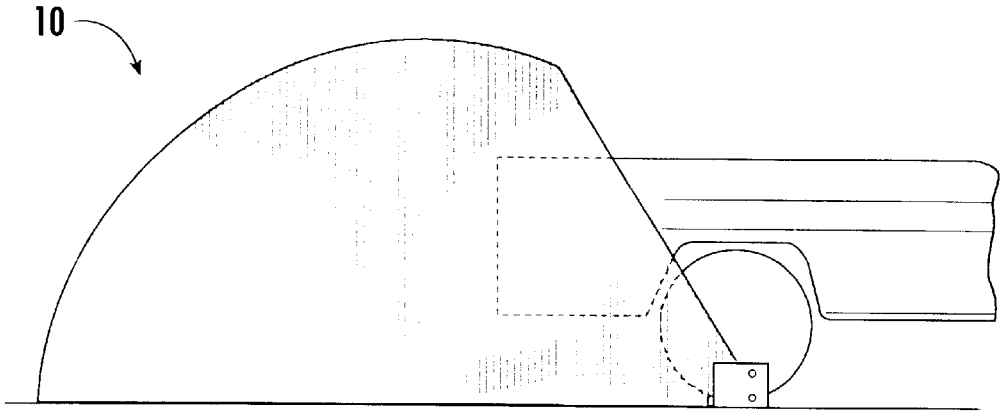
FIGS. 9A and 9B diagrammatically illustrate the manner in which the illustrated embodiment of the canopy apparatus may be erected.
Figure 9B:
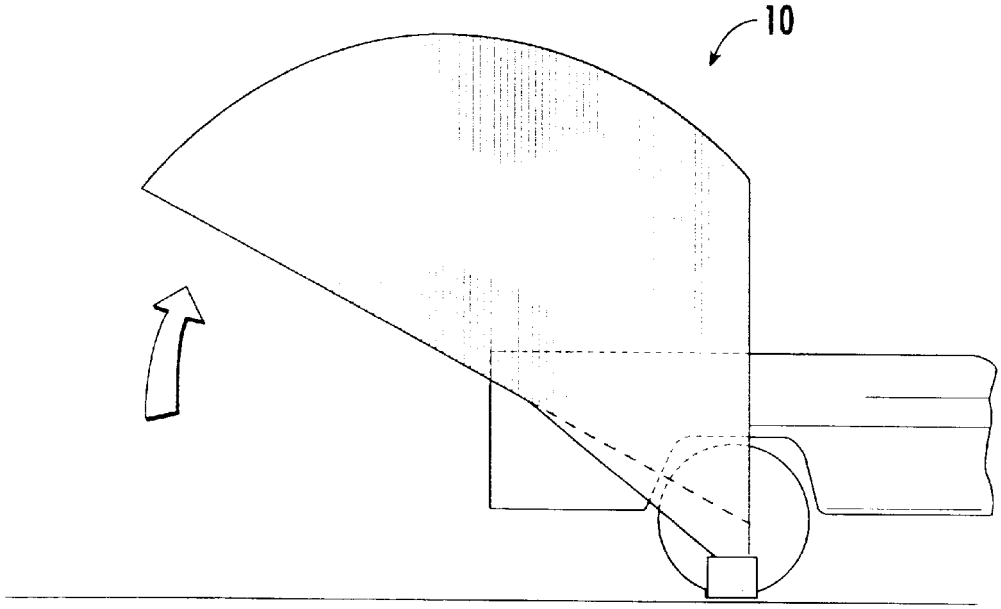

FIG. 9A illustrates the lowered position into which canopy apparatus 10 is positioned during setup. It will be appreciated that assembly or disassembly of the framework is facilitated in this manner. After the framework is assembled, and the flexible web material is secured in position, the entire structure may be pivoted upward as shown in FIG. 9B. A locking mechanism, such as that described above with reference to FIG. 7, may then be utilized to maintain the canopy structure in the upstanding position.

While preferred embodiments of the invention have been described, those skilled in the art will recognize that modifications and variations may be made thereto. For example, while three-piece cross members were illustrated, it will be appreciated that various two-piece cross members may also be utilized. In such embodiments, one end rod may carry a single slidable element that can be moved axially onto the other end rod and locked in the manner set forth above. It may also be desirable to situate a foam cylinder or other resilient material about each of the upstanding support members to alleviate scratching of the vehicle's paint as the canopy apparatus is erected and used. Those skilled in the art will also appreciate that the lowered canopy shown in FIG. 9A may be adapted for use as a small tent.

Aspects of the various embodiments may also be interchanged both in whole or in part. Furthermore, those of ordinary skill in the art will appreciate that the foregoing description is by way of example only, and is not intended to be limitative of the invention set forth in the appended claims.

What is claimed is:

1. A canopy apparatus for use at the end of a vehicle, said canopy apparatus comprising:

a base structure having anchoring plate portions configured to be respectively placed under opposite lateral wheels of said vehicle, said base structure being thereby maintained in position;

first and second support members spaced apart from one another by a predetermined separation, said support members having respective proximal ends connected to said base structure said support members being pivotally connected to said base structure for movement between a lowered position and an upstanding position;

a web support frame connected to respective distal portions of said support members and extending outwardly therefrom in a direction away from said vehicle; and a flexible web material being maintained by said web support frame to provide a covered canopy region underneath.

2. A canopy apparatus as set forth in claim 1, wherein said web support frame defines an arcuate configuration extending outwardly from distal ends of said support members.

3. A canopy apparatus as set forth in claim 2, wherein said web support frame comprises first and second parallel arcuate members and a plurality of cross members extending therebetween.

4. A canopy apparatus as set forth in claim 2, further comprising at least one diagonal strap to tension said flexible web material on said web support frame.

5. A canopy apparatus as set forth in claim 2, wherein said flexible web material defines a pair of opposed side panels.

6. A canopy apparatus as set forth in claim 5, wherein said side panels are adapted to be maintained in either of a first position partially raised along a diagonal and a second position lowered substantially to ground level.

7. A canopy apparatus as set forth in claim 1, wherein said support members and said web support frame each comprise a plurality of shorter rod elements connected together via removable connection mechanisms.

8. A canopy apparatus as set forth in claim 1, wherein said base structure comprises first and second base plate units associated with respective of said vehicle wheels.

9. A canopy apparatus as set forth in claim 3, wherein said flexible web material defines a pair of opposed side panels adapted to be maintained in a first position partially raised along a diagonal and a second position lowered substantially to ground level.

10. A quick setup canopy apparatus comprising:

a base structure adapted to be anchored in position by a motor vehicle;

first and second support members spaced apart from one another by a predetermined separation, said support members having respective proximal ends pivotally connected to said base structure for movement between a lowered position and an upstanding;position;

a web support frame defining an arcuate configuration extending outwardly from respective distal portions of said support members in a direction extending away from said motor vehicle; and a flexible web material being maintained by said web support frame to provide a covered canopy region underneath.

11. A canopy apparatus as set forth in claim 10, wherein said base structure is adapted to be anchored in position by wheels of a motor vehicle.

12. A canopy apparatus as set forth in claim 11, wherein said base structure comprises first and second base plate units associated with respective vehicle heels.

13. A canopy apparatus as set forth in claim 10, wherein said base structure comprises a locking mechanism operative to maintain said support members in said upstanding position.

14. A canopy apparatus as set forth in claim 10, wherein said web support frame comprises first and second parallel arcuate members and a plurality of cross members extending therebetween.

15. A canopy apparatus as set forth in claim 14, wherein said support members and said web support frame each comprise a plurality of shorter rod elements connected together via removable connection mechanisms.

16. A canopy apparatus as set forth in claim 10, further comprising at least one diagonal strap to tension said flexible web material on said web support frame.

17. A canopy apparatus for use at the end of a vehicle, said canopy apparatus comprising:

a base structure having anchoring plate portions configured to be placed under respective lateral wheels of said vehicle, said base structure being thereby maintained in position;

first and second support members spaced apart from one another by a predetermined separation, said support members having respective proximal ends pivotally connected to said base structure for movement between a lowered position and an upstanding position;

a web support frame defining an arcuate configuration extending outwardly from respective distal portions of said support members;

a flexible web material being maintained by said web support frame to provide a covered canopy region underneath, said flexible web material defining a pair of opposed side panels adapted to be maintained in either of a first position partially raised along a diagonal and a second position lowered substantially to ground level; and at least one diagonal strap to tension said flexible web material on said web support frame.

18. A canopy apparatus as set forth in claim 17, wherein said support members and said web support frame each comprise a plurality of shorter rod elements connected together via removable connection mechanisms.

* * * * *

UNITED STATES PATENT AND TRADEMARK OFFICE

CERTIFICATE OF CORRECTION

PATENT NO. : 6,394,118 B1
DATED : May 28, 2002
INVENTOR(S) : Donald S. Cikanowick and Gary Munson It is certified that error appears in the above-identified patent and that said Letters Patent is hereby corrected as shown below:

Column 1,
Line 61, please insert the word -- diagonal -- between the words “one” and “strap”

Column 6,
Line 67, please change the word “heels” to -- wheels --

Signed and Sealed this

Twenty-first Day of January, 2003

JAMES E. ROGAN
*Director of the United States Patent and Trademark Office*